US012332006B1

(12) United States Patent
Vitulli

(10) Patent No.: US 12,332,006 B1
(45) Date of Patent: Jun. 17, 2025

(54) FIREARM MAGAZINE RETENTION SYSTEM WITH POSITIVE POSITIONING FEATURE

(71) Applicant: Brandon Vitulli, Thomasville, GA (US)

(72) Inventor: Brandon Vitulli, Thomasville, GA (US)

( * ) Notice: Subject to any disclaimer, the term of this patent is extended or adjusted under 35 U.S.C. 154(b) by 3 days.

(21) Appl. No.: 18/543,085

(22) Filed: Dec. 18, 2023

(51) Int. Cl.
*F41A 17/38* (2006.01)

(52) U.S. Cl.
CPC ..... *F41A 17/38* (2013.01)

(58) Field of Classification Search
CPC ..... F41A 17/38
USPC ..... 42/6, 50
See application file for complete search history.

(56) References Cited

U.S. PATENT DOCUMENTS 11,054,203 B2 * 7/2021 Rodriguez ..... F41A 17/38
2022/0299284 A1 * 9/2022 Tasyagan ..... F41A 35/06

* cited by examiner

*Primary Examiner* — Reginald S Tillman, Jr.
(74) *Attorney, Agent, or Firm* — J. Wiley Horton

(57) ABSTRACT

A firearm magazine retention and release system providing a motion-limiting engagement between a firearm and a magazine. The magazine is provided with a catch opening. The firearm is provided with a magazine catch having a protrusion positioned to engage the catch opening. The protrusion includes one or more sloping surfaces that provide a greater vertical engagement as the protrusion is urged further into the catch opening. The result is that the protrusion engages one or more edges of the catch opening—thereby inhibiting vertical travel of the magazine with respect to the firearm.

20 Claims, 18 Drawing Sheets

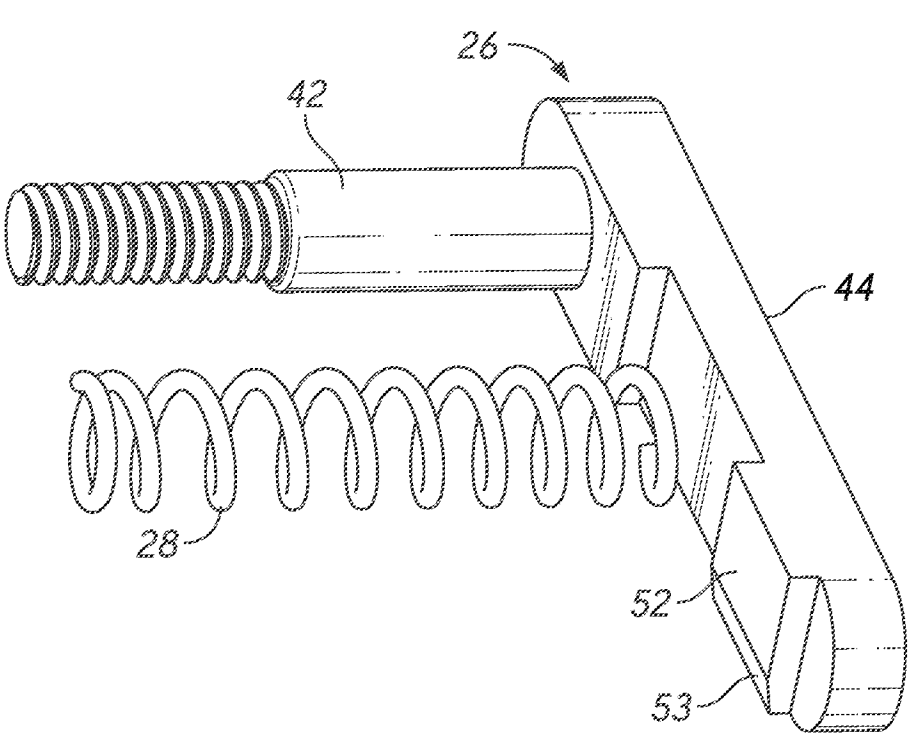
FIG. 5
(Prior Art)
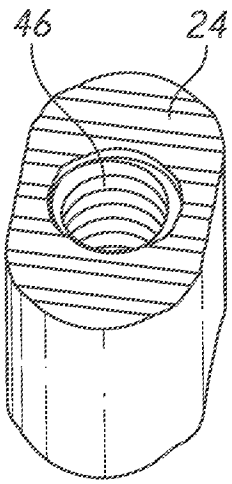

FIREARM MAGAZINE RETENTION SYSTEM WITH POSITIVE POSITIONING FEATURE

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of firearms. More specifically, the invention comprises a magazine and magazine catch arrangement that both retains the magazine within the firearm and positively locates the magazine with respect to the firearm.

2. Description of the Related Art

The present invention is potentially applicable to any firearm having a detachable magazine. As will be apparent to those knowledgeable in the field, the designs disclosed herein can be modified and adapted in many forms. It is impractical to illustrate all these possibilities. Accordingly, only an exemplary application will be described in detail.

FIGS. 1-9 illustrate a common prior art firearm having a detachable box magazine. The firearm is a representative member of the broad class of AR15/M16/M4-type. It will serve well to illustrate the present invention, though the reader should bear in mind that the present invention can be easily adapted to other types of rifles, pistols, shotguns, etc.

Directional terms used in this description are defined with respect to the firearm itself. "Longitudinal" is a direction that is along the bore of the firearm's barrel. Forward is proceeding toward the muzzle and rearward is proceeding away from the muzzle. "Lateral" is a direction that is perpendicular to the longitudinal direction and also horizontal when the firearm is held in a normal firing position by a human user. "Right" refers to the right side of the firearm in a normal firing position and "left" refers to the left side of the firearm in a normal firing position. "Vertical" is a direction that is perpendicular to both the longitudinal and lateral directions when the firearm is held in a normal firing position.

FIG. 1 provides a right-side perspective view of firearm 10. The receiver in this type of weapon is divided into lower receiver 12 and upper receiver 14. Butt stock 16 connects to the lower receiver, as does rear grip 18. Magazine well 20 is also an integral part of the lower receiver. The magazine well is a tapered opening leading upward into a cavity configured to receive detachable magazine 22. The magazine contains a stack of rifle cartridges that are urged upward by a follower atop an internal magazine spring.

Magazine 22 is held within lower receiver 12 by a magazine retention and release system. Magazine release button 24 is part of the magazine retention and release system. In order to release magazine 22 the user presses magazine release button 22 inward. Magazine 22 can then be grasped and pulled free. In some firearms the magazine will simply fall free when the magazine release button is pressed.

FIG. 2 provides a left-side perspective view of the same prior art firearm. Magazine catch 26 moves in and out of lower receiver 12 under the influence of magazine release button 24 (on the other side) and an associated return spring. The magazine catch serves to selectively retain or release magazine 22—as will be described in more detail subsequently.

The magazine retention and release system for this exemplary firearm only involves the lower receiver and the retention and release mechanism attached thereto. FIG. 3 provides an exploded perspective view showing the relevant components. The upper receiver, butt stock, barrel assembly, and many other components have been omitted for purposes of visual clarity. With the upper receiver removed, magazine cavity 32 is visible. This cavity runs vertically through lower receiver 12. Magazine well 20 surrounds the open lower end of the magazine cavity. Magazine 22 is designed to slide upward into magazine cavity 32 until the two feed rails 36 at the top of the magazine extend well above mating plane 34 (mating plane 34 being the meeting point between the lower receiver and the upper receiver).

The magazine retention and release system in this example include magazine release button 24, spring 28, and magazine catch 26. These three components are retained within transverse passages in lower receiver 12. Magazine release button 24—as an example—slides into magazine release button pocket 30 in the right side of lower receiver 12.

FIG. 4 provides a left-side exploded view depicting the same components shown in FIG. 3 (Directional terms such as "left" and "right" being understood with respect to the firearm itself as explained previously). The reader will note that magazine catch 26 comprises bar 44 attached to shaft 42. The far end of shaft 42 has a male thread sized to thread into a female thread in hole 46 of magazine release button 24. Shaft 42 passes through transverse bore 40 in lower receiver 12, through the middle of coil spring 28, and then threads into hole 46. The installation process will be familiar to those skilled in the art: The user slides shaft 42 through transverse bore 40 and slides spring 28 over the exposed shaft. Bar 44 is held outside of magazine catch pocket 38. The user presses magazine release button 24 far inward to compress spring 28 and bring the female thread in hole 46 in contact with the male thread on shaft 42. The use then rotates bar 44 to thread the end of shaft 42 into hole 46. The left side of spring 28 bears against a stop within lower receiver 12. When the user releases the button 24, button 24 and magazine catch 26 both move to the right with respect to the lower receiver. This causes bar 44 to slide into magazine catch pocket 38—which retains the bar and prevents further rotation of magazine catch 26. Bar 44 then translates left and right within magazine catch pocket 38, but does not rotate.

FIG. 5 shows the components of the magazine retention and release system in more detail. The reader will note the female threads in hole 46 in magazine release button 24. The reader will also note the male threads on shaft 42. The inner diameter of spring 28 is sized to slide freely over shaft 42.

Bar 44 of mag catch 26 is fixed to shaft 42. In other words, bar 44 does not rotate at all with respect to shaft 42. Bar 44 includes protrusion 52, which operates to retain the magazine within the lower receiver. The lower portion of protrusion 52 is often provided with a chamfer 53.

Looking back at FIG. 4, the operation of these components will be described in more detail. Once installed, magazine release button 24 and magazine catch 26 move left and right in unison (with respect to lower receiver 12). Spring 28 is compressed between the left side of magazine release button 24 and an internal stop surface within lower receiver 12. The spring tends to urge button 24 and magazine catch 26 to the right. This motion to the right is arrested by bar 44 abutting a stop surface within magazine catch pocket 38. Pressing the magazine release button 24 urges magazine catch 26 to the left. When the button is released the magazine catch returns to the right.

In looking at magazine 24, the reader will note the presence of lateral catch opening 48. This is an opening through the side wall of the magazine. Opening 48 is a bit larger than protrusion 52 (see FIG. 5) on the magazine catch. Looking against at FIG. 4, when the user pushes magazine 22 upward, protrusion 52 on magazine catch 26 will ride along the side of the magazine with spring 28 forcing protrusion 52 against the side of the magazine. As the magazine rises, lateral catch opening 48 will eventually align with protrusion 52 and protrusion 52 will "pop" laterally into the opening 48—thereby securing the magazine in the installed position.

This state is shown in FIG. 6. Magazine catch 26 has engaged magazine 22 and secured the magazine in the proper installed portion. Feed rails 36 are positioned to properly place the top cartridge so that the moving rifle bolt will strip the top cartridge off the magazine and feed it into the firing chamber.

Those skilled in the art will know that a magazine is often forcefully installed. Magazines must be reliably changed in a highly stressful environment. To account for the forces and speeds involved, additional features are often provided. Returning to FIG. 4, the reader will note the presence of lower stop 50 just below lateral catch opening 48. This lower stop arrests further upward motion of the magazine once the proper position is reached—either by bearing against the bottom of the magazine catch or another feature provided on the receiver (Sometimes multiple stop features are provided for redundancy). It provides a hard stop that arrests further upward motion.

Still looking at FIG. 4—an upper stop 54 is sometimes provided as well (just above lateral catch opening 48). The upper stop includes a camming surface that moves protrusion 52 to the right as the magazine moves upward toward its installed position. Protrusion 52 then passes over the bottom edge of upper stop 54 and snaps into lateral catch opening 48.

FIG. 6 includes "call out" planes for sectional views provided in FIGS. 7 and 8. FIG. 7 is a vertically oriented section view through the vicinity of the magazine catch—looking from the front of the rifle toward the rear). The reader will note how the magazine rests within magazine cavity 32 and how magazine well 20 provides a flared opening for the bottom of the magazine cavity. The magazine is shown in the installed and retained position. Magazine catch 26 has been urged to the right in the firearm (to the left in the orientation of the view) and the protrusion on the magazine stop has popped into lateral catch opening 48. The magazine cannot move further upward because the upper surface of lower stop 50 (and the bottom edge of the lateral catch opening) bear against the bottom of magazine catch 26. The magazine cannot fall downward because the upper edge of the lateral catch opening bears against the upper surface of magazine catch 26.

FIG. 7 in fact shows the magazine after a user has pushed it home and released it. The magazine tends to move downward under the influence of gravity until further downward motion is stopped by the upper surface of magazine catch 26. Tolerances are of course present in every mechanical assembly, and the lateral catch opening 48 must be made larger than the protrusion on the magazine catch in order for the two components to reliably engage. Once the magazine descends to the retained position shown, a gap a then exists between the bottom of magazine catch and the lateral catch opening.

FIG. 8 is a horizontally oriented sectional view through the vicinity of the magazine catch, looking from the top of the rifle toward the bottom. This view allows the operation of the magazine retention and release system to be easily understood. The reader will recall that—once installed—magazine catch 26 (consisting of bar 44 and shaft 42) and magazine release button 24 move in unison. These components move laterally within the lower receiver. Spring 28 is captured between magazine release button 24 and spring retention flange 82 (which is an integral part of the lower receiver in this example). The spring thus urges magazine retention button 24 to the right (up in the orientation of the view) which also urges protrusion 52 on the magazine catch into lateral catch opening 48 in the magazine.

FIG. 9 shows a sectional elevation view taken through protrusion 52 of magazine catch 26 as the magazine catch rests within lateral catch opening 48. The reader will note the amount of "slop" present between the protrusion and the lateral catch opening it is configured to engage.

The magazine is designed to slide freely within the magazine cavity. In order to slide freely, it must be made somewhat undersized. Looking against at FIG. 8, the reader will note the presence of clearances denoted as b, c, and d. The reader will thus perceive that while the magazine is in the installed and retained position, it is able to move vertically, laterally, and longitudinally.

The possible motion of the magazine while in the retained position can adversely affect a firearm's accuracy. Returning to FIG. 6, the reader will observe that the position of the magazine in the magazine cavity determines the positions of feed rails 36 (and consequently the position of the uppermost cartridge before it is engaged by the bolt and fed into the chamber). Every time a firearm is fired it undergoes a complex recoil cycle. This causes the magazine to move and often settle in a slightly altered position. The magazine is held within the magazine cavity by the prior art retention and release system but—as noted—there is significant slop in this location. The slop allows the uppermost cartridge to assume a somewhat variable position relative to the advancing firearm bolt—and this degrades accuracy. Variations in the vertical position of the magazine within the magazine well are particularly harmful to accuracy.

It is therefore desirable to provide an improved magazine retention and release mechanism that will reduce the motion of the magazine relative to the firearm, while still providing for secure retention and release. The present invention provides such a system.

BRIEF SUMMARY OF THE PRESENT INVENTION

The present invention comprises a firearm magazine retention and release system providing a motion-limiting engagement between a firearm and a magazine. The magazine is provided with a catch opening. The firearm is provided with a magazine catch having a protrusion positioned to engage the catch opening. The protrusion includes one or more sloping surfaces that provide a motion-limiting engagement as the protrusion is urged further into the catch opening. The result is that the protrusion engages one or more edges of the catch opening—thereby inhibiting vertical travel of the magazine with respect to the firearm.

Some inventive embodiments also include a protrusion that provides a greater horizontal engagement as the protrusion is urged further into the catch opening. The result is that the protrusion engages both a front and a rear edge of the catch opening—thereby inhibiting longitudinal travel of the magazine with respect to the firearm.

BRIEF DESCRIPTION OF THE SEVERAL VIEWS OF THE DRAWINGS

FIG. 5 is a perspective view, showing an exemplary prior art magazine catch, spring, and magazine release button.

REFERENCE NUMERALS IN THE DRAWINGS

Figure 1:
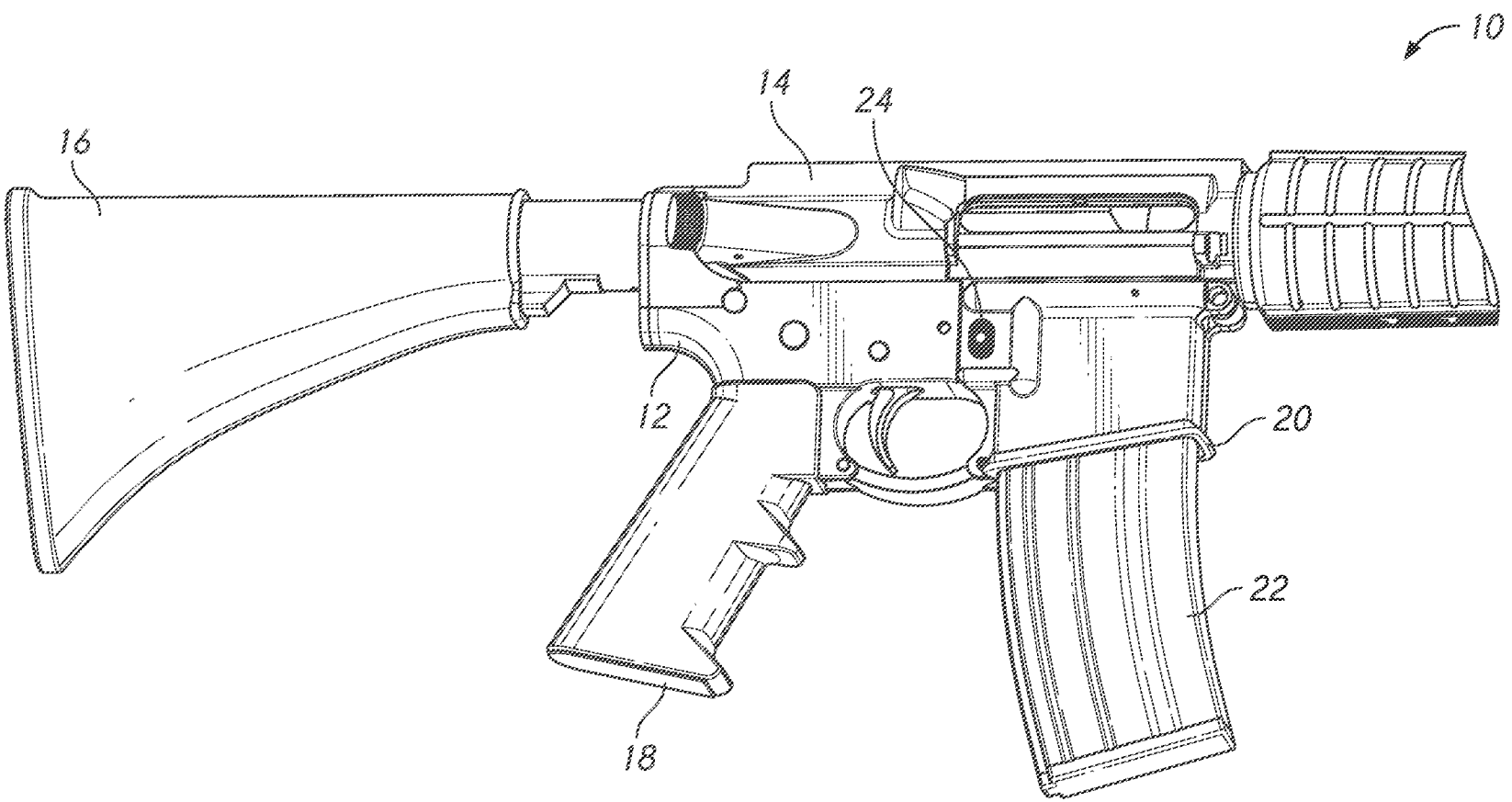
FIG. 1 (Prior Art)
FIG. 1 is a right-side perspective view, showing an exemplary prior art firearm with a detachable magazine.
Figure 2:
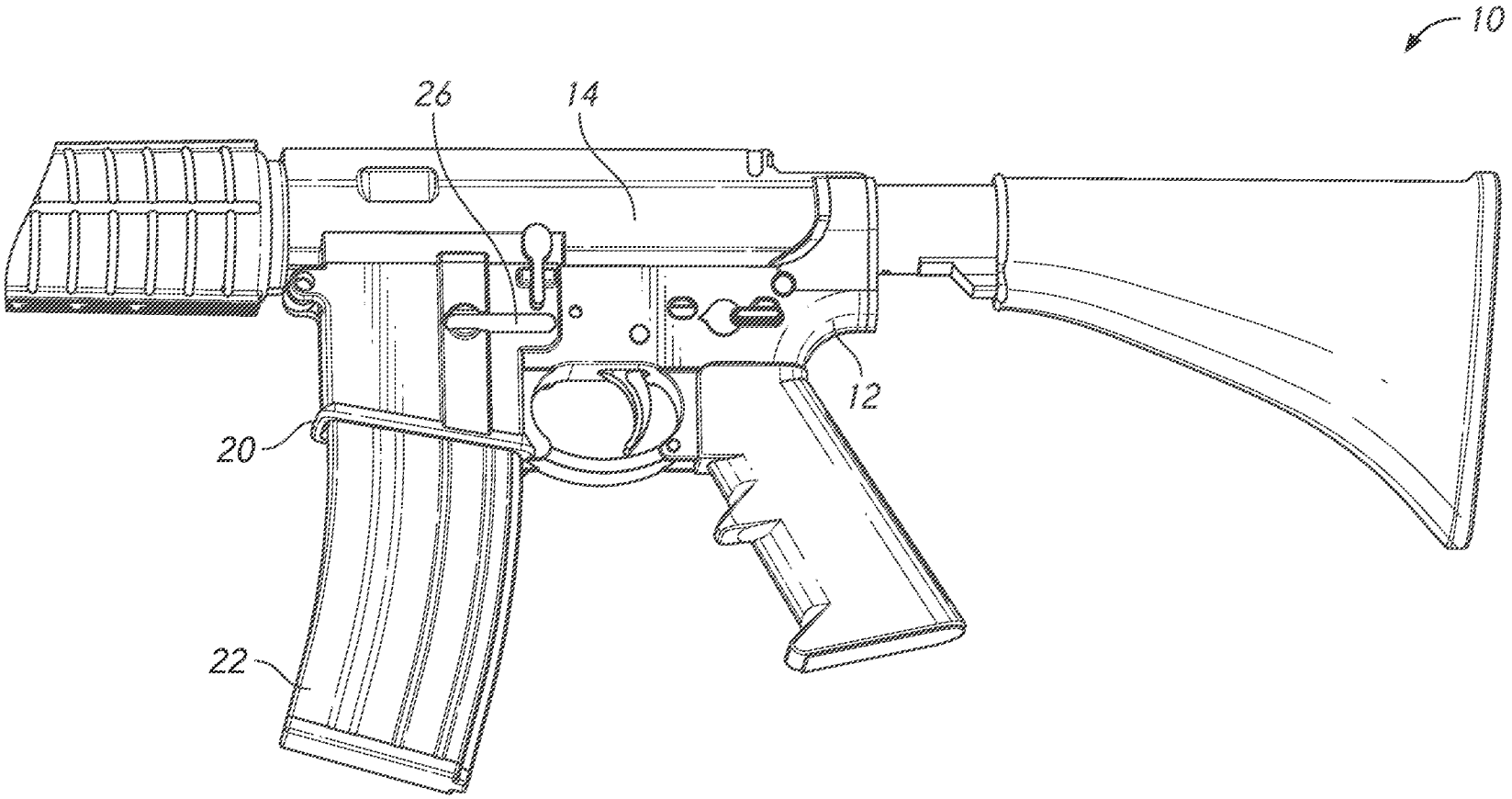
FIG. 2 (Prior Art)
FIG. 2 is a left side perspective view, showing the firearm of FIG. 1.
Figure 3:
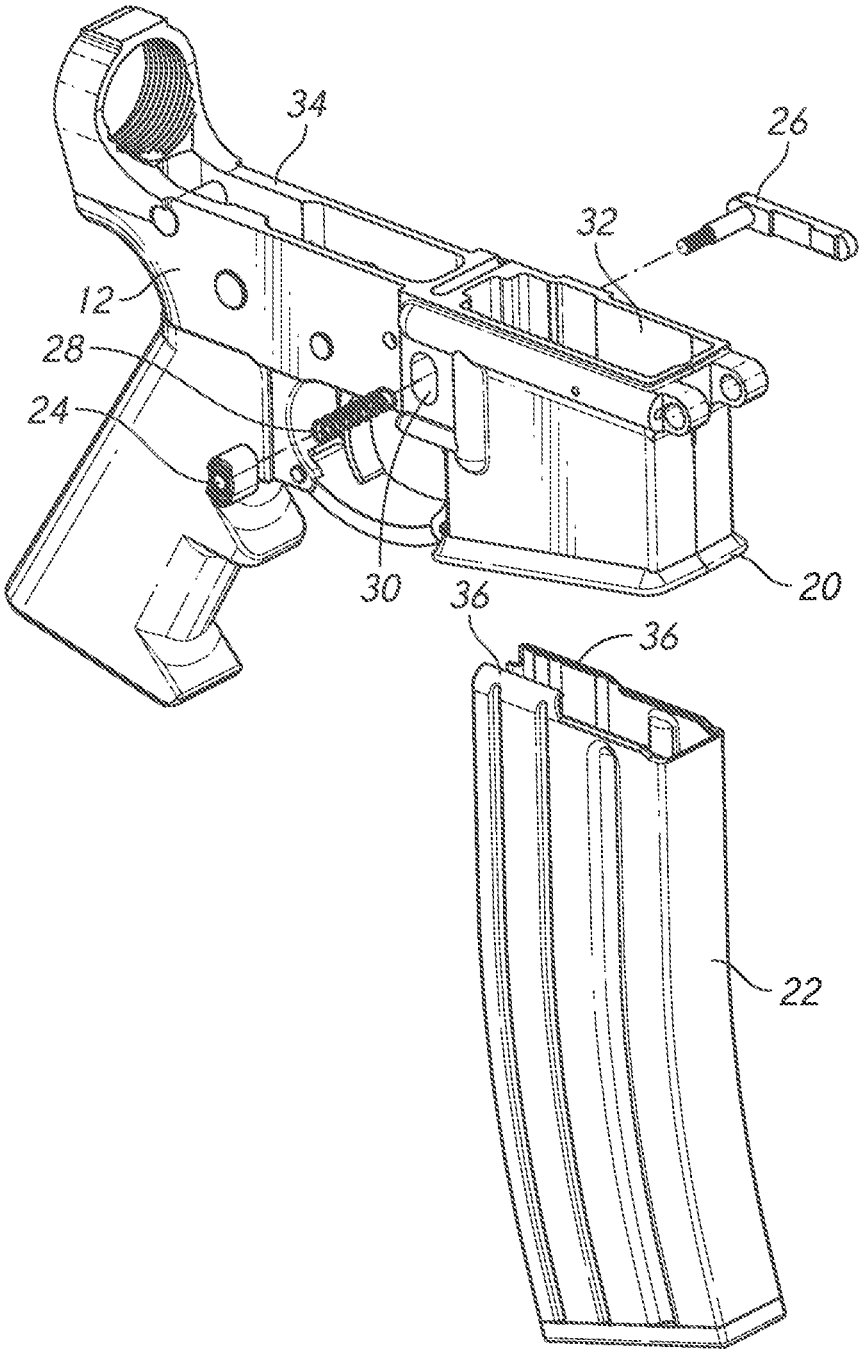
FIG. 3 (Prior Art)
FIG. 3 is an exploded perspective view, showing a firearm receiver, a detachable magazine, and associated magazine retaining components.
Figure 4:
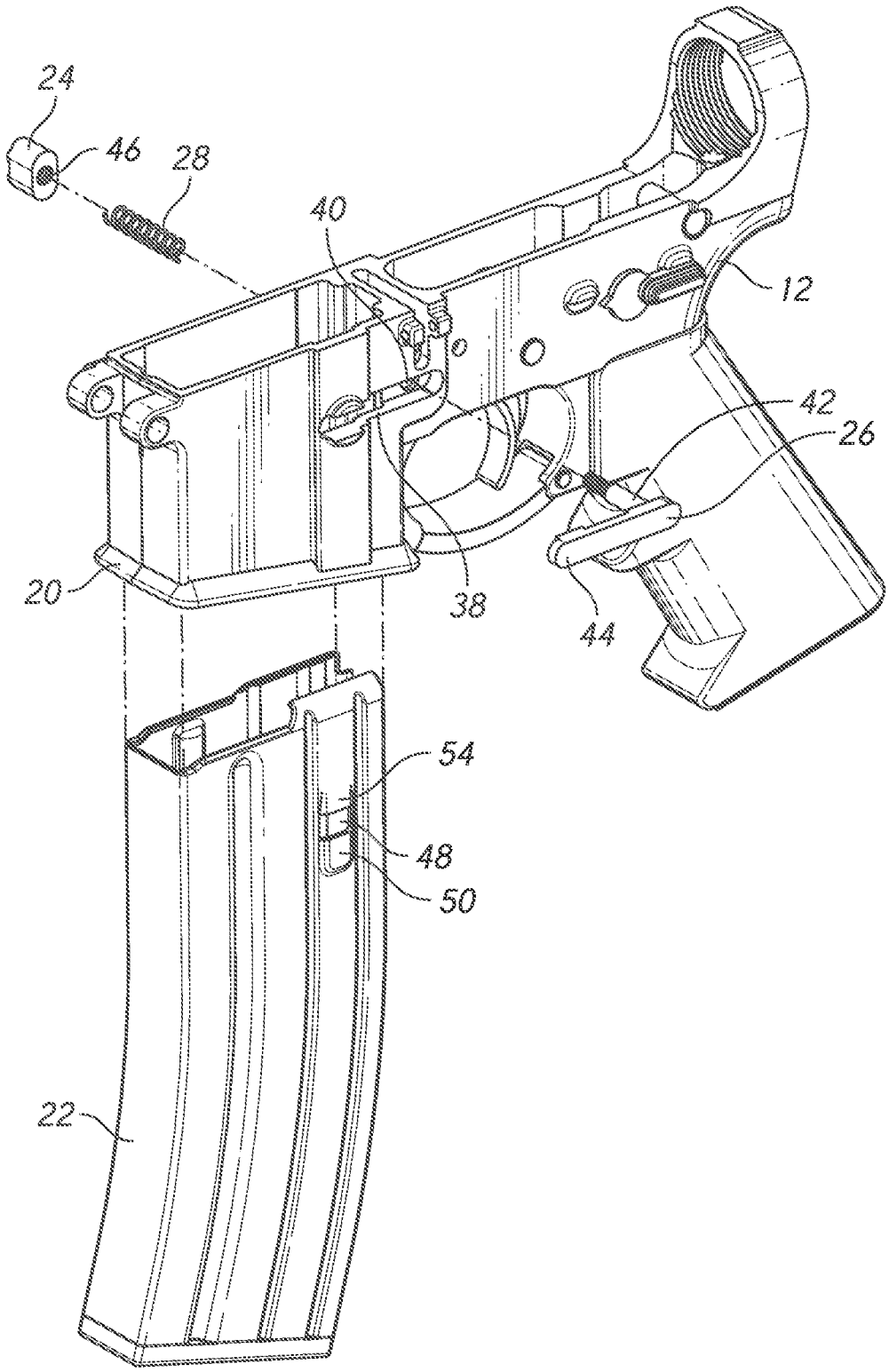
FIG. 4 (Prior Art)
FIG. 4 is an exploded perspective view, showing the assembly of FIG. 3 from a different vantage point.

10 firearm
12 lower receiver
14 upper receiver
16 butt stock
18 rear grip
20 magazine well
22 magazine
24 magazine release button
26 magazine catch
28 spring
30 magazine release button pocket
32 magazine well
34 mating plane
36 feed rail
38 magazine catch pocket
40 transverse bore
42 shaft
44 bar
46 hole
48 magazine catch opening
50 lower stop
52 protrusion
54 upper stop
56 vertical protrusion
58 horizontal protrusion
60 chamfer
62 tapered surface
64 tapered surface
66 magazine
68 horizontal catch opening
70 vertical catch opening
72 lower stop
76 tapered surface
78 vertical projection
80 tapered surface
82 spring retention flange

DETAILED DESCRIPTION OF THE INVENTION

Figure 10:
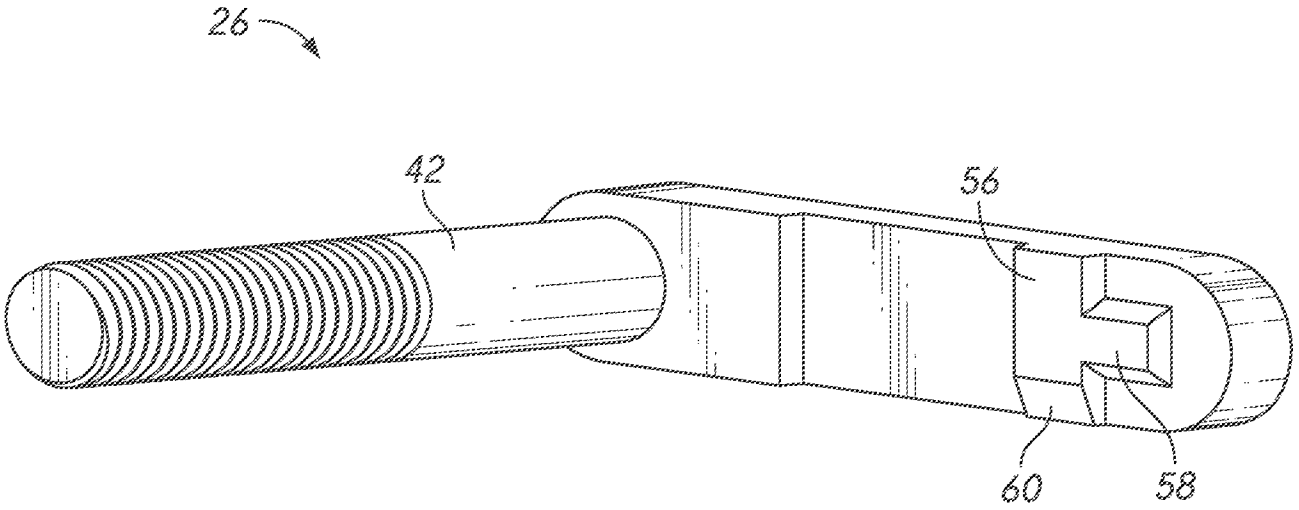
FIG. 10 is a perspective view, showing a magazine catch made according to the present invention.

The inventive magazine retention and release system incorporates a new type of magazine catch and a new type of magazine catch opening. Many different embodiments reflecting the inventive concepts are possible. FIGS. 10-15 illustrate a first exemplary embodiment. FIG. 10 shows how magazine catch 26 incorporates a threaded shaft 42 and bar 44 as for the prior embodiments. Bar 44 also incorporates a protrusion positioned to extend inward toward the magazine. The protrusion is altered however. The version shown incorporates horizontal protrusion 58 and an intersecting vertical protrusion 56. The two protrusions intersect to form the shape of a "T" laid on its side. Chamfer 60 is preferably provided on the lower portion of vertical protrusion 56. It serves the same purpose as chamfer 53 on the prior art magazine catch (see FIG. 5)—smoothing the impact of the magazine on the magazine catch when the magazine is pushed up toward its installed position.

Figure 6:
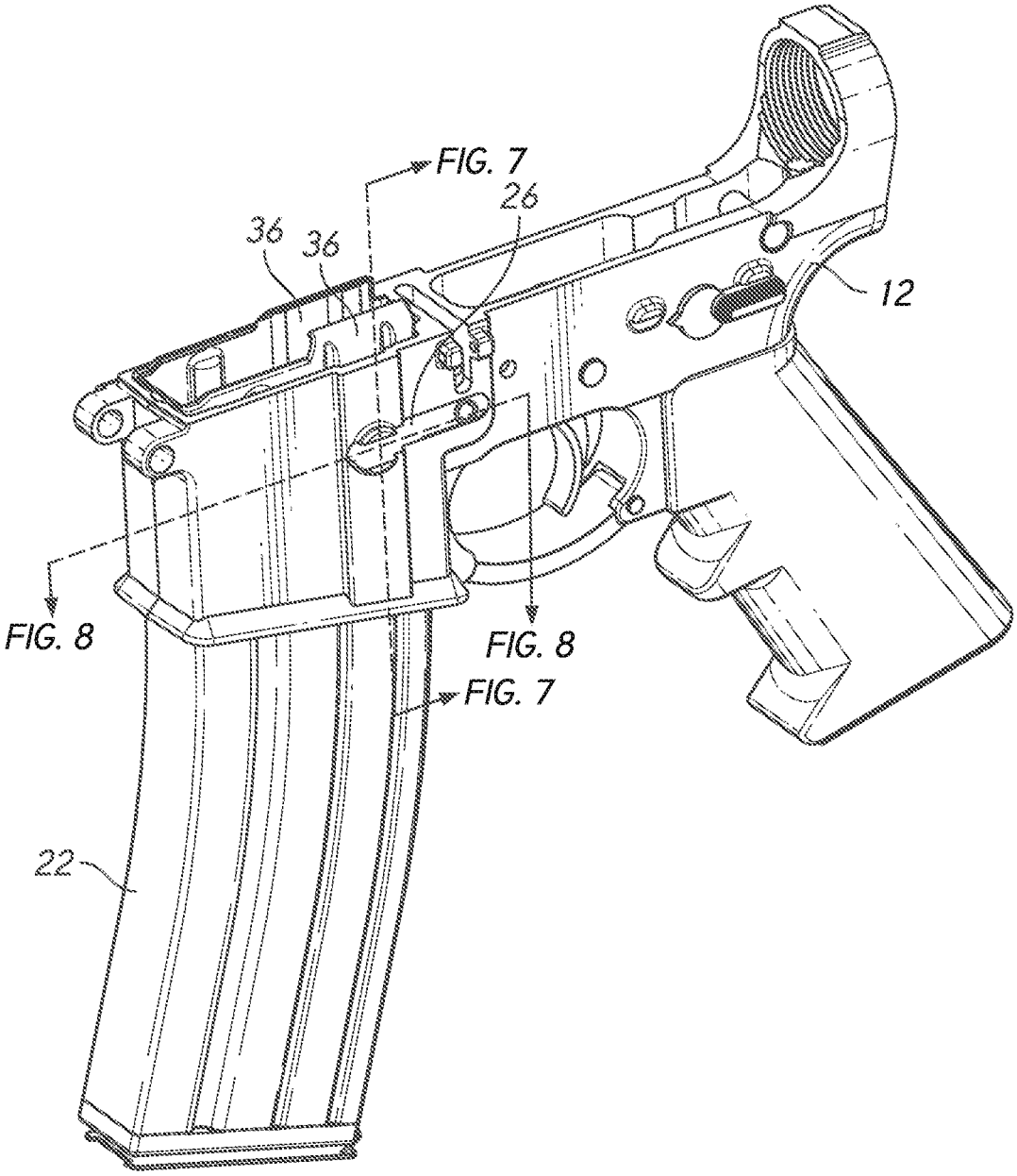
FIG. 6 (Prior Art)
FIG. 6 is a perspective view, showing the components of FIGS. 4 and 5 in an assembled state.
Figure 7:
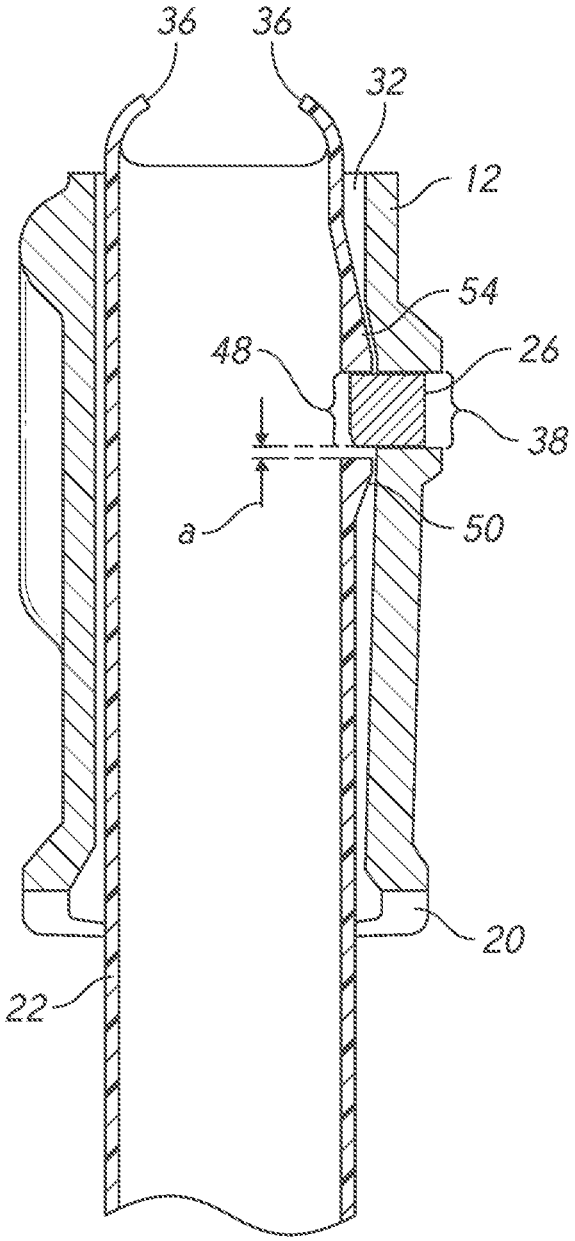
FIG. 7 is a sectional elevation view, showing how a magazine catch retains a detachable magazine.
Figure 8:
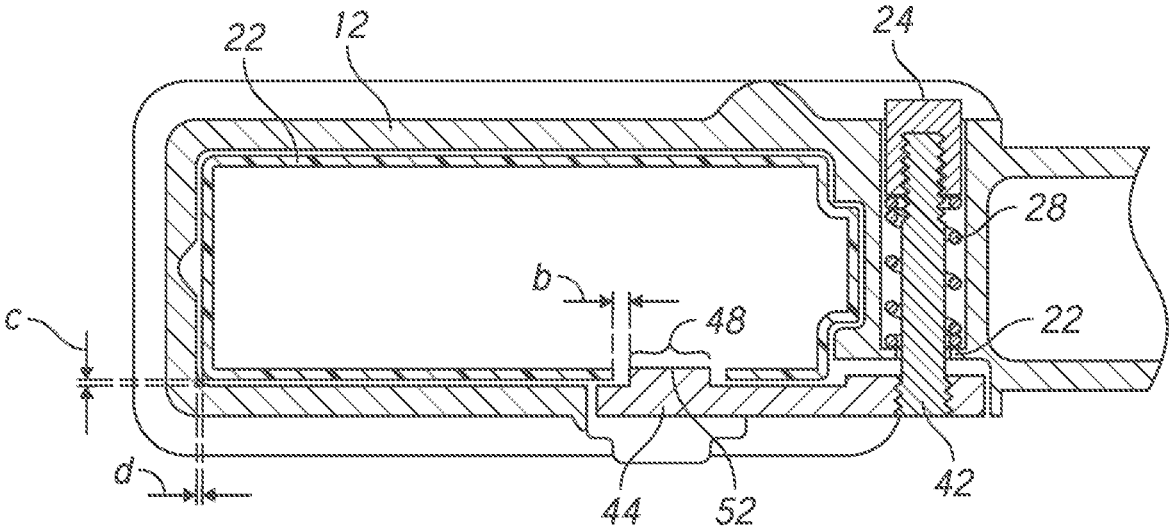
FIG. 8 is a sectional plan view, showing how a magazine catch retains a detachable magazine.
Figure 9:
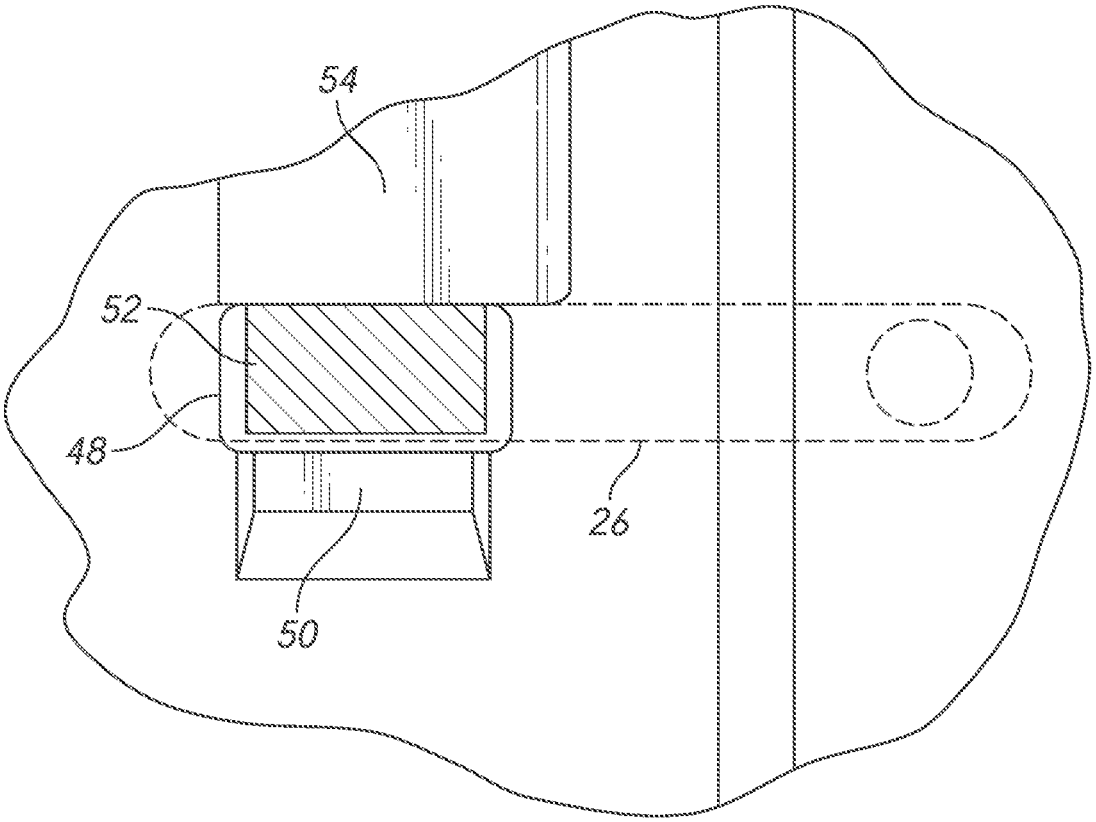
FIG. 9 (Prior Art)
FIG. 9 is a sectional elevation view, showing how a magazine catch retains a detachable magazine.
Figure 11:
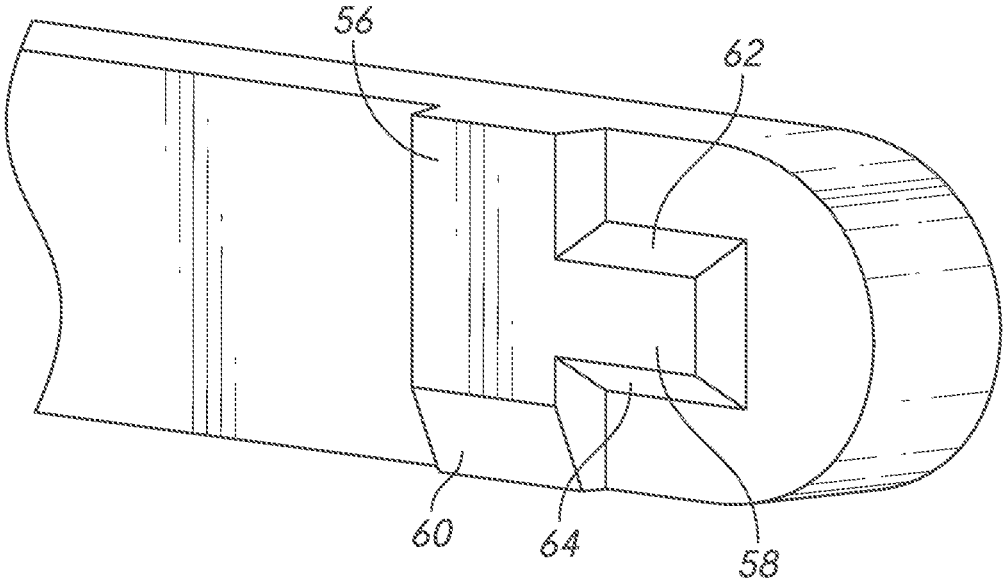
FIG. 11 is a detailed perspective view, showing the latching protrusion area of the magazine catch of FIG. 10.

FIG. 11 provides an enlarged view of the vicinity of vertical protrusion 56 and horizontal protrusion 58. The upper and lower boundary of horizontal protrusion 58 are not perpendicular walls. Instead, tapered surface 62 is provided on the upper boundary and tapered surface 64 is provided on the lower boundary. The presence of these tapered surfaces 62,64 means that the vertical thickness of horizontal protrusion 58 decreases when proceeding in the direction the magazine catch moves when engaging the catch opening on the magazine. In the example shown, the magazine catch is located on the left side of the firearm (see FIG. 6), and it moves toward the right side of the firearm in order to engage the magazine (Since FIG. 11 shows the engagement side of the magazine catch the motion would be from right to left, or toward the viewer, in the orientation shown in FIG. 10).

Figure 12:
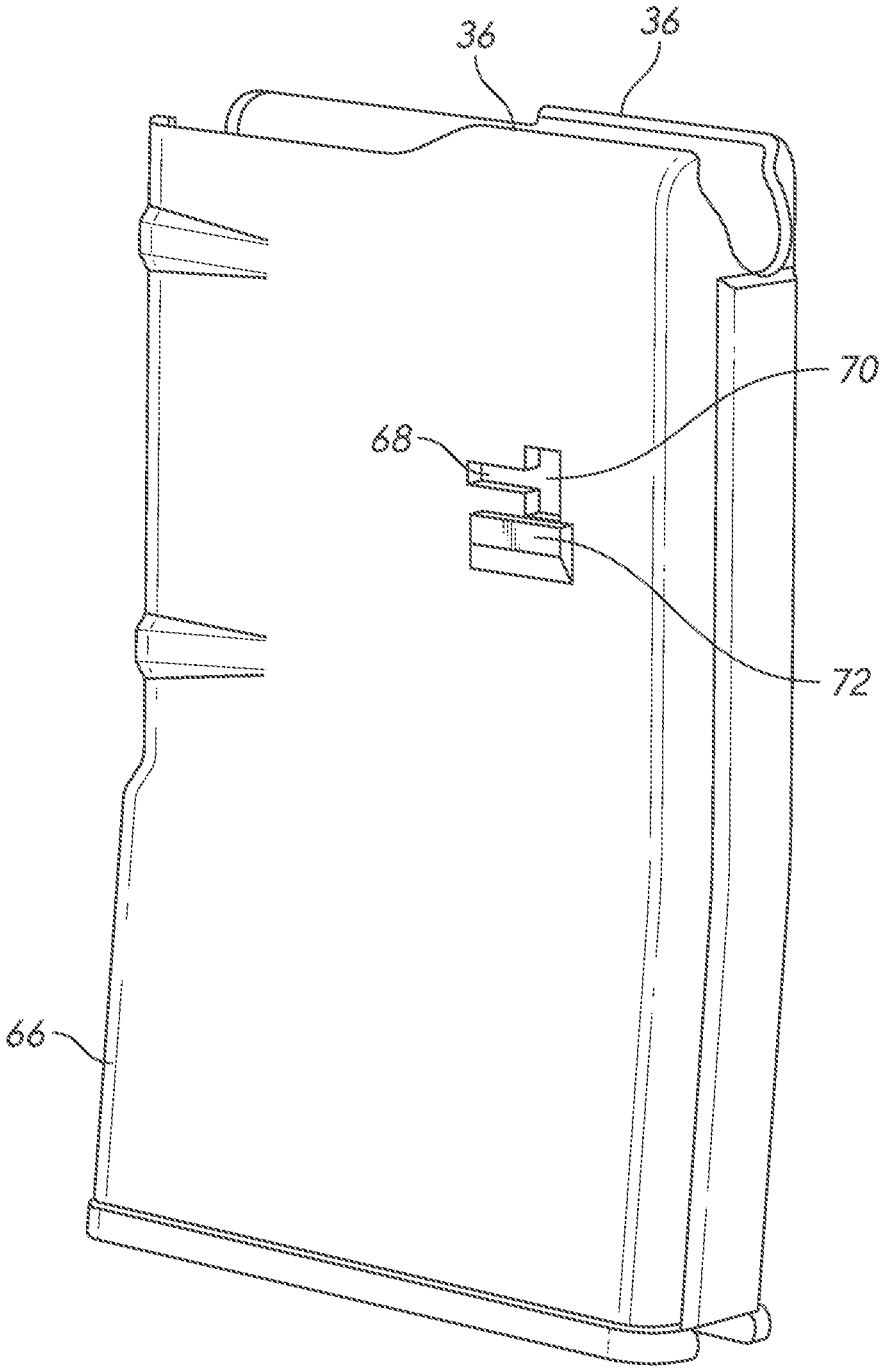
FIG. 12 is a perspective view, showing a magazine made according to the present invention.

FIG. 12 shows a perspective view of magazine 66, which is made according to the present invention. This magazine includes a lateral catch opening in generally the same location as the lateral catch opening in a prior art magazine. However, the shape of the lateral catch opening has been modified. It is made in the same approximate shape as the combined horizontal and vertical protrusions on the magazine catch (a "T" laid on its side). Horizontal catch opening 68 is configured to receive horizontal protrusion 58 on the magazine catch. Vertical catch opening 70 is likewise configured to receive vertical protrusion 56. Lower stop 72 is provided as for the prior art. An upper stop may be provided as well—though these are usually omitted on modern magazine designs.

Figure 13:
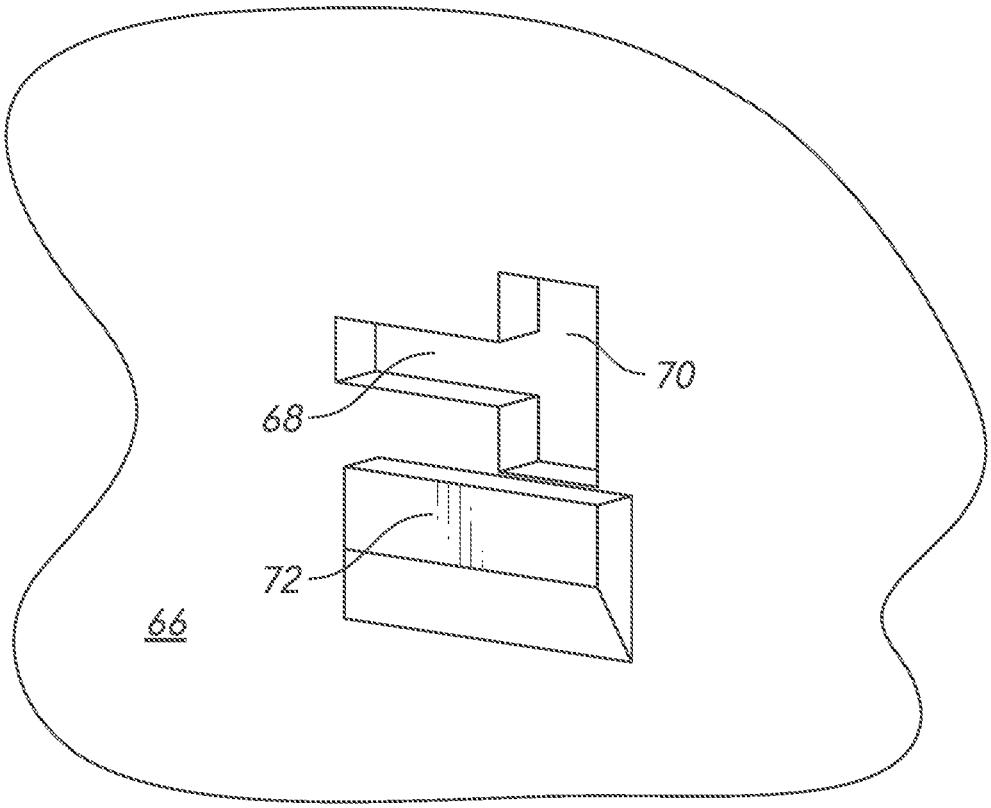
FIG. 13 is a detailed perspective view, showing the area of the horizontal catch opening.

FIG. 13 shows an enlarged view of the inventive catch opening in the magazine. The reader will note how horizontal catch opening 68 intersects with vertical catch opening 70 to create the form of a "T" laid on its side. The walls of the openings in this example are perpendicular to the outer magazine surface.

Figure 14:
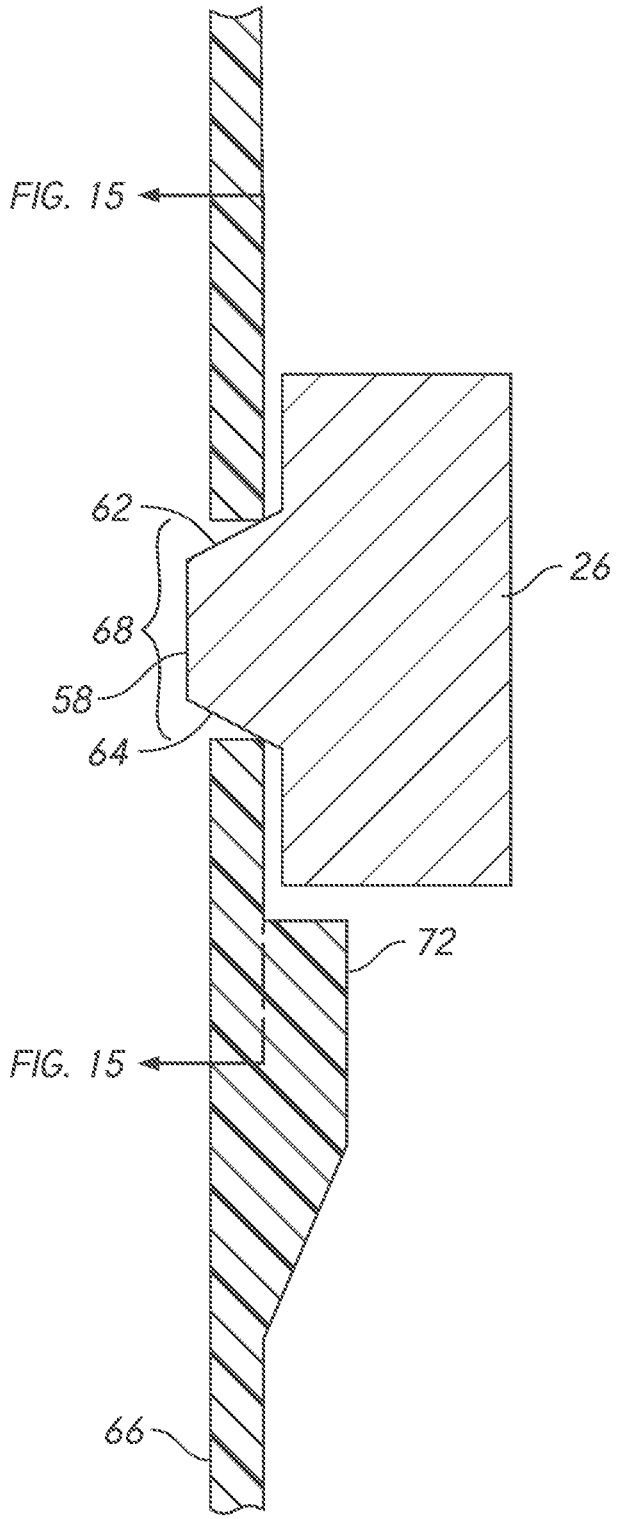
FIG. 14 is a sectional elevation view, showing the interaction of the inventive magazine catch with the inventive magazine catch opening.

When the inventive magazine is pushed upward into the magazine cavity, the magazine catch engages by moving inward toward the center of the magazine—as in the prior art. FIG. 14 shows a sectional elevation view through the region of the magazine catch after it has engaged and retained the magazine. Horizontal protrusion 58 on the magazine catch 26 has moved inward toward the center of the magazine, causing protrusion 58 to engage horizontal catch opening 68. Further, the tapered nature of the horizontal protrusion means that the protrusion has engaged both the upper and lower edges of horizontal catch opening 68. The reader will note that tapered surface 62 has engaged the upper edge of the horizontal catch opening and tapered surface 64 has engaged the lower edge. The tapered surfaces create a camming or wedging action as the protrusion 58 moves toward the center of the magazine—thereby positively locating the magazine in the vertical direction.

Figure 15:
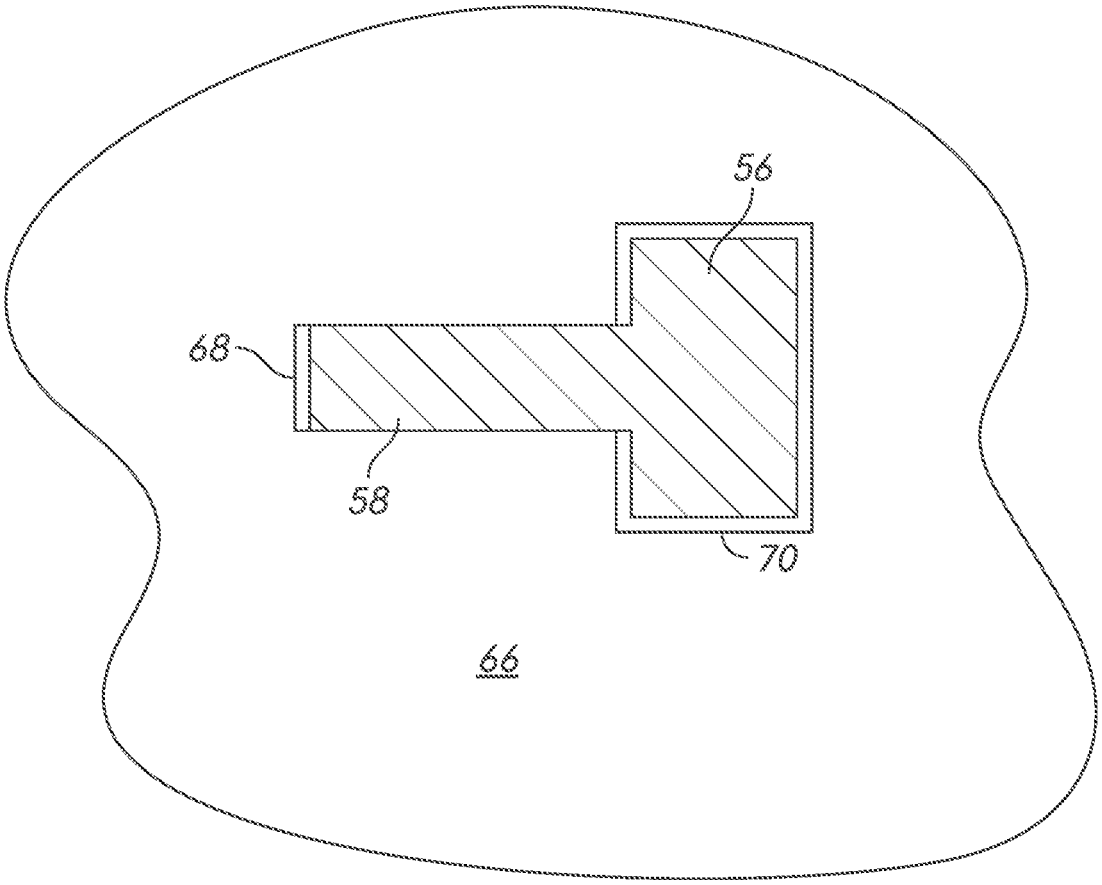
FIG. 15 is a sectional elevation view, showing the interaction of the inventive magazine catch with the inventive magazine catch opening.

FIG. 15 shows a vertical section view through the protrusion of the magazine catch as it rests within the catch opening (Note the position of the "call outs" in FIG. 14, with the sectional plane being just outside of the magazine wall). The reader will observe how the horizontal protrusion 58 fully occupies the vertical extent of horizontal catch opening 68. Vertical protrusion 56 rests within vertical catch opening 70 as well.

The magazine is thus vertically constrained by the magazine catch. The tapered walls 62,64 center the horizontal catch opening as they engage the horizontal catch opening. They act as wedging surfaces and will move the magazine slightly up or down as needed to center the horizontal protrusion 58 in horizontal catch opening 68. Once engaged as shown, the magazine is no longer free to move up and down with the movement of the firearm (especially firing cycles). The vertical position of the magazine is fixed. This increases accuracy and eliminates unwanted rattling sounds made by a moving magazine.

Returning to FIG. 15, the reader will note that some clearance remains between vertical protrusion 56 and vertical catch opening 70. This clearance allows the magazine to move to a limited extent in a direction that is parallel to the firearm's longitudinal axis (forward and rearward). Another embodiment can be provided that limits this travel as well.

Figure 16:
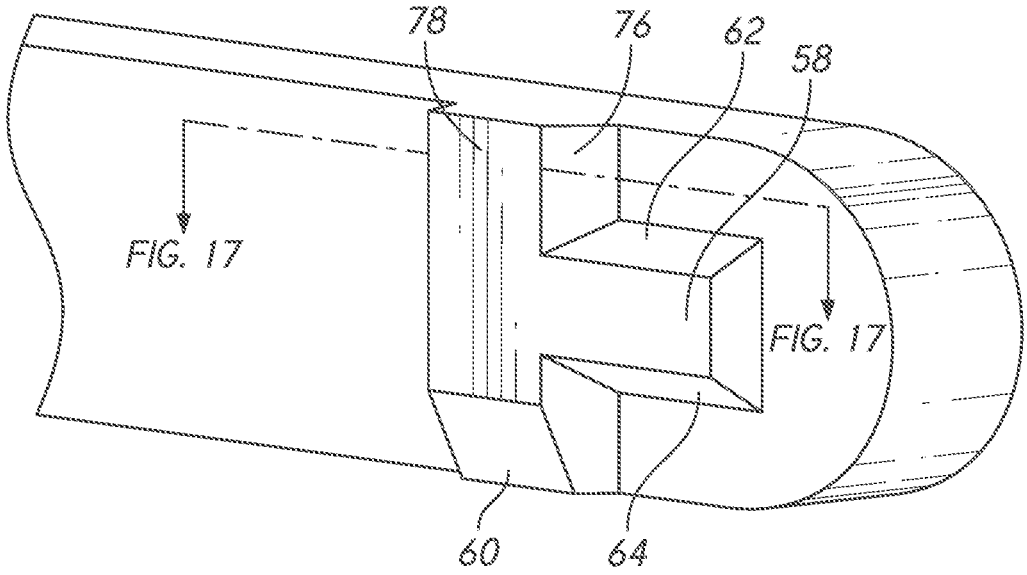
FIG. 16 is a detailed perspective view, showing an alternate embodiment of the inventive magazine catch.
Figure 17:
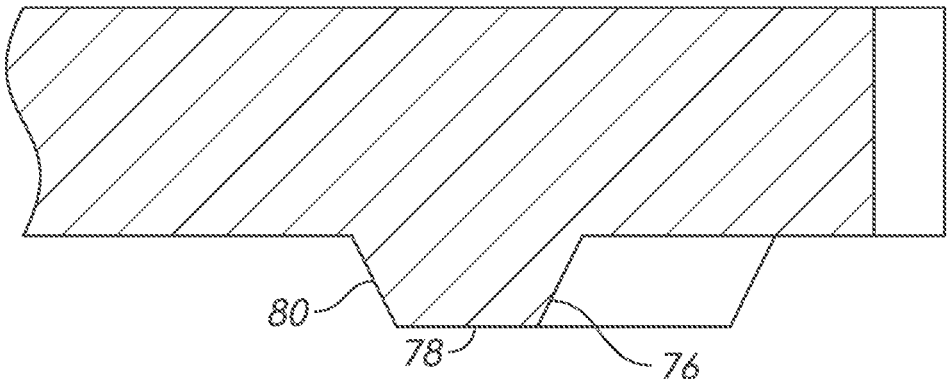
FIG. 17 is a sectional view, showing the alternate embodiment of FIG. 16.

FIG. 16 shows an alternate embodiment in which one or more tapered surfaces are provided for vertical protrusion 78 in addition to the tapered surfaces 62,64 provided for horizontal protrusion 58. FIG. 17 shows a sectional view through vertical protrusion 78. In this example, tapered surface 76 and tapered surface 80 are provided on the forward and rearward surfaces respectively. Tapered surfaces 76,80 are configured to engage the forward and rearward vertical edges of vertical catch opening 70 (shown in FIG. 13). The wedging action of these tapered surfaces will tend to center the vertical catch opening—thereby limiting the forward and rearward movement of the magazine in its installed position.

Figure 18:
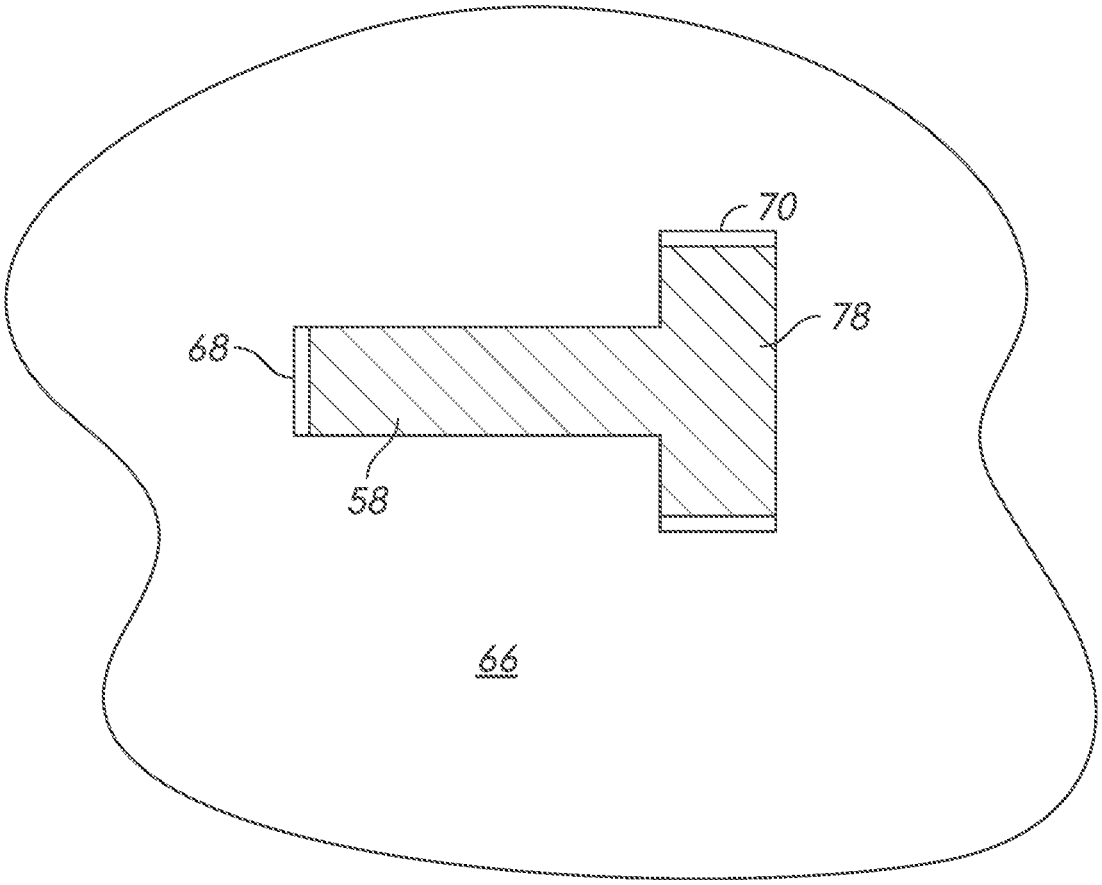
FIG. 18 is a sectional elevation view, showing the interaction of the alternate embodiment with the inventive magazine catch opening.

FIG. 18 shows a sectional elevation view of the protrusion of FIG. 16 as it engages the magazine catch opening in the magazine. The tapered walls of horizontal protrusion 58 positively engage the upper and lower edges of horizontal catch opening 68. Similarly, the tapered walls of vertical protrusion 78 positively engage the forward and rearward edges of vertical catch opening 70. The motion of the magazine is thus constrained in the vertical and lateral directions.

The reader should bear in mind that the use of the word "tapered" to describe the walls of the protrusions does not necessarily mean a linear taper. The taper can be a linear taper, but a curved geometry or some other geometry may be employed as well. The word taper in this context just means that the thickness of the protrusion decreases when proceeding toward the center of the magazine.

The catch openings shown for the magazine have included walls that are perpendicular to the outer surface of the magazine. This need not always be the case. The walls for the catch opening can be tapered as well.

The direction of taper will depend on the location of the magazine catch and how it moves to retain and release the magazine. There are many different types of magazines and magazine catches in the prior art. The exemplary firearm in the drawing views is a AR15/M16/M4-type weapon. These are usually configured for right-handed operation. The bar 44 of magazine catch 26 lies on the left side of the firearm and to the left of the magazine. Bar 44 moves to the right so that the protrusion extending to the right from the bar engages the catch opening on the left side of the magazine. Thus, the protrusion extending to the right of the magazine bar is tapered when proceeding from left to right (The right end of the protrusion is thinner than the left end).

In other magazine/catch combinations the protrusion will move from right to left and the protrusion will need to be tapered when proceeding from right to left. In still other examples the magazine catch engages the front of the magazine and moves from front to rear during engagement. The protrusion in that example would be tapered when proceeding from front to rear. In general, one can state that most protrusions on a magazine catch engage and retain the magazine by moving toward the center of the magazine and release the magazine by moving away from the center of the magazine. Thus, according to the present invention, the engaging protrusion on a magazine catch should be tapered proceeding in the direction the protrusion moves when engaging and retaining the magazine.

In the example shown, the inventive magazine catch is configured to be compatible with prior art magazines as well. In other words, a rifle incorporating the inventive magazine catch can receive and engage prior art magazines as well.

Many other features can be included in the inventive embodiments. These features may also be combined in various permutations. Examples include:

1. Tapered catch opening walls that conform to the taper provided on the magazine catch protrusion(s);
2. A non-tapered protrusion interfacing with tapered catch opening walls;
3. A round protrusion having tapered walls;

4. An oval protrusion having tapered walls;
5. A molded polymer magazine;
6. A molded polymer magazine with a metal insert in the vicinity of the catch opening;
7. A purely metal magazine; and
8. The spring used to bias the magazine catch and its protrusion toward the magazine can be a coil spring, a leaf spring, a compressible piece of polymer, or anything else that provides the desired force urging the protrusion into engagement with the catch opening.

Although the preceding descriptions contain significant detail, they should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the following claims rather than the examples given.

I claim:

1. A magazine retention and release system for retaining a magazine having a magazine catch opening in a firearm, comprising:
(a) a magazine catch attached to said firearm, said magazine catch having a protrusion protruding toward said magazine;
(b) said protrusion having a tapered surface, with said tapered surface causing a width of said protrusion to diminish when proceeding in a direction toward a center of said magazine;
(c) a spring biasing said protrusion of said magazine catch toward said center of said magazine; and
(d) wherein said tapered surface bears against an edge of said magazine catch opening, thereby camming said magazine to a fixed position in which said protrusion bears against said first edge of said magazine catch opening and a second edge of said magazine catch opening.

2. The magazine retention and release system as recited in claim 1, wherein:
(a) said protrusion has a second tapered surface opposite said first tapered surface;
(b) said second tapered surface bears against a second edge of said magazine catch opening.

3. The magazine retention and release system as recited in claim 2, wherein:
(a) said magazine catch opening includes a horizontal catch opening;
(b) said edge of said magazine catch opening is an upper edge of said horizontal catch opening; and
(c) said second edge of said magazine catch opening is a lower edge of said horizontal catch opening.

4. The magazine retention and release system as recited in claim 3, wherein:
(a) said magazine catch opening includes a vertical catch opening; and
(b) said protrusion includes a vertical portion sized to fit within said vertical catch opening.

5. The magazine retention and release system as recited in claim 4, wherein said protrusion is in the form of a tee.

6. The magazine retention and release system as recited in claim 5, wherein:
(a) said protrusion includes a horizontal protrusion; and
(b) said horizontal protrusion includes said tapered surface and said second tapered surface.

7. The magazine retention and release system as recited in claim 1, wherein said tapered surface has a linear taper.

8. A magazine retention and release system for retaining a magazine having a magazine catch opening in a firearm, comprising:
(a) a magazine catch attached to a first side of said firearm, said magazine catch having a protrusion protruding toward a second side of said firearm;
(b) said protrusion having a tapered surface, with said tapered surface causing a width of said protrusion to diminish when proceeding in a direction toward said second side of said firearm;
(c) a spring biasing said protrusion of said magazine catch toward said second said of said firearm; and
(d) wherein said tapered surface bears against an edge of said magazine catch opening, thereby camming said magazine to a fixed position.

9. The magazine retention and release system as recited in claim 8, wherein:
(a) said protrusion has a second tapered surface opposite said first tapered surface;
(b) said second tapered surface bears against a second edge of said magazine catch opening.

10. The magazine retention and release system as recited in claim 9, wherein:
(a) said magazine catch opening includes a horizontal catch opening;
(b) said edge of said magazine catch opening is an upper edge of said horizontal catch opening; and
(c) said second edge of said magazine catch opening is a lower edge of said horizontal catch opening.

11. The magazine retention and release system as recited in claim 10, wherein:
(a) said magazine catch opening includes a vertical catch opening; and
(b) said protrusion includes a vertical portion sized to fit within said vertical catch opening.

12. The magazine retention and release system as recited in claim 8, wherein said protrusion is in the form of a tee.

13. The magazine retention and release system as recited in claim 12, wherein:
(a) said protrusion includes a horizontal protrusion; and
(b) said horizontal protrusion includes said tapered surface and said second tapered surface.

14. The magazine retention and release system as recited in claim 1, wherein said tapered surface has a linear taper.

15. A magazine retention and release system for a firearm, comprising:
(a) a magazine, having a horizontal catch opening with an upper edge and a lower edge;
(b) a magazine catch attached to a first side of said firearm, said magazine catch having a protrusion protruding toward a second side of said firearm, said protrusion being aligned with said horizontal catch opening;
(c) said protrusion having a first tapered surface, with said first tapered surface causing a width of said protrusion to diminish when proceeding in a direction toward said second side of said firearm;
(d) a spring biasing said protrusion of said magazine catch toward said second said of said firearm; and
(d) wherein said first tapered surface bears against said upper edge of said horizontal catch opening.

16. The magazine retention and release system as recited in claim 15, wherein:
(a) said protrusion has a second tapered surface opposite said first tapered surface; and
(b) said second tapered surface bears against said lower end of said horizontal catch opening.

17. The magazine retention and release system as recited in claim 16, wherein said first and second tapered surfaces in combination cam said magazine into a fixed vertical position.

18. The magazine retention and release system as recited in claim 15, wherein said protrusion is in the form of a tee.

19. The magazine retention and release system as recited in claim 18, wherein:

(a) said protrusion includes a horizontal protrusion; and (b) said horizontal protrusion includes said tapered surface and said second tapered surface.

20. The magazine retention and release system as recited in claim 15, wherein said tapered surface has a linear taper.

* * * * *